US006300379B2

(12) United States Patent
Avery

(10) Patent No.: US 6,300,379 B2
(45) **Date of Patent: *Oct. 9, 2001**

(54) PRODUCTION OF STABLE HYDROLYZABLE ORGANOSILANE SOLUTIONS

(75) Inventor: Richard W. Avery, Racine, WI (US)

(73) Assignee: S. C. Johnson & Son, Inc., Racine, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/274,273

(22) Filed: Mar. 22, 1999

(51) Int. Cl.[7] ..... B01F 17/54

(52) U.S. Cl. ..... 516/55; 516/53; 252/182.11; 106/287.1; 106/287.11; 106/287.12; 106/287.13; 106/287.14; 106/287.15

(58) Field of Search ..... 106/287.1, 287.11, 106/287.12, 287.13, 287.14, 287.15; 252/182.11; 516/53, 55

(56) References Cited

U.S. PATENT DOCUMENTS

| | | | | |
|---|---|---|---|---|
| 2,479,850 | | 8/1949 | Marks . | |
| 3,671,644 | | 6/1972 | Irani et al. . | |
| 3,997,460 | | 12/1976 | Sirine et al. . | |
| 4,069,066 | | 1/1978 | Hindle et al. . | |
| 4,597,887 | | 7/1986 | Colodney et al. . | |
| 4,743,395 | | 5/1988 | Leifheit . | |
| 4,978,685 | | 12/1990 | Gannon et al. . | |
| 5,330,674 | | 7/1994 | Urfer et al. . | |
| 5,411,585 | | 5/1995 | Avery et al. . | |
| 5,454,984 | | 10/1995 | Graubart et al. . | |
| 5,476,615 | | 12/1995 | Hall et al. . | |
| 5,522,942 | | 6/1996 | Graubart et al. . | |
| 5,531,814 | | 7/1996 | Bahr et al. . | |
| 5,591,708 | | 1/1997 | Richter et al. . | |
| 5,622,708 | | 4/1997 | Richter et al. . | |
| 5,629,280 | | 5/1997 | Richter et al. . | |
| 6,113,815 | * | 9/2000 | Elfersy et al. | 252/588 |

* cited by examiner

*Primary Examiner*—Jill Warden
*Assistant Examiner*—Monique T. Cole

(57) ABSTRACT

An aqueous composition formed by mixing a hydrolyzable silicon compound having a low solubility in water (e.g a fluorosilane), a major proportion of water, and a surfactant, also contains an effective amount of a co-solvent (e.g. certain glycol ethers) which is sparingly soluble in water to improve the stability of the composition. The composition may be used for surface treatment.

20 Claims, No Drawings

PRODUCTION OF STABLE HYDROLYZABLE ORGANOSILANE SOLUTIONS

TECHNICAL FIELD

The present invention relates to aqueous compositions containing siloxane compounds which have a low solubility in water or are insoluble in water.

BACKGROUND ART

U.S. Pat. No. 5,411,585 discloses a method of improving the stability of aqueous media containing certain organosilanes with silicon-bonded hydrolyzable groups. As explained in U.S. Pat. No. 5,411,585 such aqueous compositions have various uses. The hydrolyzable groups enable the compounds to attach themselves to suitable surfaces. The organosilanes are not stable in aqueous media, however, and U.S. Pat. No. 5,411,585 discloses that the stability of aqueous solutions of defined organo-silanes may be improved by the addition of a) a defined water-soluble organic quaternary ammonium compound and b) certain surfactants other than the quaternary ammonium compound. The patent specification defines the organo-silane as being water-soluble at 25° C. and states that organo-silanes which do not give clear solutions at 25° C. are not useful.

Organo-silicon compounds are available which have low solubilities in water and which thus do not form clear solutions in water. Thus fluoro-silanes are available which are hydrolyzed by water and may be used to treat surfaces to impart desirable properties to them. The mixture of water and fluoro-silane has however a pot life of only a few hours before it becomes unusable. This makes it impossible to market a ready-mixed aqueous product which is suitable for consumer use and which has an acceptable shelf-life for retail sales.

U.S. Pat. No. 5,531,814 discloses an aqueous composition containing silicon compounds and various water-soluble solvents. The silicone compounds are siloxane compounds, i.e., they contain chains of Si—O groups. Among the solvents listed is propylene glycol n-butyl ether and dipropylene glycol n-butyl ether. There is no suggestion that the aqueous compositions have any problem with lack of stability.

It has now been found that problems with the stability of hydrolysable silicon compounds having poor solubility in water may be reduced by choice of a limited class of co-solvents.

DISCLOSURE OF INVENTION

An aqueous composition formed by mixing a hydrolyzable silicon compound having a low solubility in water, a major proportion of water, and a surfactant wherein the composition contains an effective amount of a co-solvent which is sparingly soluble in water.

According to a further aspect of the present invention there is provided a method of forming an aqueous composition which comprises mixing together:

a) a major proportion of water, b) a surfactant, and c) a hydrolyzable silicon compound having a low solubility in water, wherein an effective amount of a co-solvent which is sparingly soluble in water is included in the mixture.

The co-solvent is sparingly soluble in water. It is preferred to use co-solvents which have percentage solubilities in water at 20° C. in the range 1% to 25% by weight, more preferably 4% to 25%, and, most preferably 5% to 10%. All percentages herein are expressed as weight percent.

The hydrolyzable silicon compound has a low solubility in water, i.e., it does not form a clear solution in water at 25° C. when mixed with water only in a proportion of hydrolyzable silicon compound corresponding to that in which is present in the composition of the invention. As the composition of the invention contains a major proportion of water it follows that the solubility test mixture will contain a major proportion of water. The hydrolyzable silicon compound may be supplied as a concentrated solution in an organic solvent, e.g., ethanol, and may not be available as the pure compound. In such a case it is the amount of silicon compound in the form in which it is supplied which is used to determine whether a clear solution is formed. Thus hydrolyzable silicon compounds suitable for use in the present invention may be supplied as liquid concentrates containing up to 50% of ethanol. Such concentrates may be used to produce aqueous ethanol solutions containing a major proportion of ethanol and minor amounts of water (e.g. 95%/5%). If, however, a clear solution is not produced when the concentrate is mixed with water to give a mixture containing a major amount, e.g., 50% of water, then it has a low solubility in water for the purposes of the invention.

The hydrolyzable silicon compound will generally be a silane. The silane may have the general formula $A_{3-x}B_xSiD$ wherein A is —OH or a hydrolyzable group, B is an alkyl group of from 1 to 4 carbon atoms which may be substituted, and x=0, 1, or 2, and D is a hydrocarbon group which may be substituted.

The above general formula embraces the organo-silanes disclosed in U.S. Pat. No. 5,411,585. The skilled reader will understand that only those organo-silanes are used in the present invention which fail the water solubility test given in U.S. Pat. No. 5,411,585: namely, those which do not form a clear solution in water at 25° C. at the intended level of use. The skilled reader will be able to determine whether a given hydrolyzable silicon meets the solubility requirements of the present invention by simple non-inventive tests.

Preferably A is a hydrolyzable group, e.g., an alkyl ether group, more preferably an alkyl ether group having a lower alkyl group having 1–4 carbon atoms, e.g., methoxy.

Preferably D is substituted by fluorine. Thus D may contain from 6 to 18 carbon atoms, preferably 6 to 12 carbon atoms, and may comprise a carbon chain carrying predominantly fluorine atoms.

The hydrolyzable silicon compound preferably has the general formula Rf—X—$Si(OR)_3$, where Rf is a perfluoroaliphatic group, X is a linking group preferably comprising an unsubstituted lower alkylene group, and R is methoxy or ethoxy.

A specific example of a hydrolyzable silicon compound which may be used in the present invention is a fluor aliphatic silyl ether available under the designation FC-405-60 from 3M Industrial Chemical Products. This is stated to have the general formula Rf—A—$Si(OMe)_3$, where Rf is a fluoroaliphatic group, and A is a linking group which is not specifically identified in the description of the formula. More specifically the active ingredient is 1-octanesulphonamide, N-ethyl-1,1,2,2,3,3,4,4,5,5,6,6,7,7,8,8-heptadecafluoro-N-3-(trimethoxy silyl)propyl. It is supplied as a solution in ethanol containing 60%–64% fluorocompound, and 35–39% ethanol, and 1% methyl ethyl ketone.

Another specific example of a hydrolyzable silicon compound suitable for use in the present invention is triethoxy (3,3,4,4,5,5,6,6,7,7,8,8,8-(tridecafluorooctyl)silane) available from Huels under the trade name Dynasylan F8621.

The quantity of hydrolyzable silicon compound is preferably 0.01% to 3%, more preferably 0.05 to 1% of active ingredient, based on total weight of aqueous composition.

The composition of the present invention contains a major proportion of water. Thus the composition preferably contains at least 50% of water, more preferably at least 70%, most preferably at least 80%.

The surfactant may be a cationic surfactant, a non-ionic surfactant, or an amphoteric surfactant or may be a mixture.

The quantity of surfactant may, for example, be in the range 1 to 10%, based on the total weight of composition, more preferably 2 to 5% and measured as active ingredient.

The co-solvent is responsible for providing improved stability to the composition. Stability has two aspects. One aspect is physical stability, i.e., whether the composition separates into layers either immediately after it has been formed or after a period of standing. The other aspect is chemical stability, i.e., whether the composition retains activity, e.g., the ability to modify surface properties after being allowed to stand for a prolonged period of time. The use of the co-solvent serves to improve both aspects of stability. Sometimes one aspect may be improved more than the other and it may be necessary to balance the requirements of improved physical stability against those of improved chemical stability.

As explained above it is preferred to use co-solvents which have solubilities in water at 20° C. in the range 1 to 25%, more preferably 4% to 10%.

Examples of suitable co-solvents are propylene glycol n-butyl ether, dipropylene glycol n-butyl ether, and dipropylene glycol n-propyl ether.

The co-solvent is used in an effective amount. There is clearly a minimum level required to obtain an observable effect. There is also a maximum level beyond which the advantages obtained using the co-solvent decrease with increasing amounts of co-solvent. Once the inventive concept underlying the present invention has been explained the person skilled in the art can determine the optimum levels of co-solvent by simple non-inventive tests. The minimum amount of co-solvent may for example be not less than 1% based on total weight of composition, preferably not less than 4%. The maximum amount is preferably not more than 9%, more preferably not more than 6% of the total composition.

BEST MODE OF CARRYING OUT THE INVENTION

Comparative Test A

An aqueous composition was prepared by mixing together the ingredients given in Table 1 in the order given with vigorous agitation. In this comparative test (not according to the invention) a co-solvent was not used.

The composition separated into separate layers immediately after preparation. No tests on stability or effectiveness over a one (1) month period could be made.

Comparative Test B

A composition was prepared as in Test A, but using a co-solvent with good water solubility, namely propylene glycol methyl ether supplied by Dow under the trade name "Dowanol PM". This is completely miscible with water at 20° C. The initial stability of the composition was assessed, and the hydrophobic effect obtained by treating glass with the composition. The hydrophobic effect was tested as follows. The composition was applied to one half of a glass plate and ability of the composition to provide a hydrophobic surface was assessed by observing the tendency of water to form beads and be repelled from the treated side when the plate was immersed in water. Before the test the plate was washed with an aqueous solution of a commercially available liquid dishwashing detergent and was then well-rinsed with water.

The physical stability of the composition (as measured by its tendency to separate into its components) was assessed after storage of samples for one month at a) ambient temperature, b) 40° C. The chemical stability of the composition as shown by the hydrophobic effect on glass surfaces produced by the composition after storage at ambient temperature for one month was also assessed as described above.

The initial stability was good and the initial hydrophobic effect was strong. However the composition separated into layers on storage for one month both at ambient temperature and at 40° C., and the hydrophobic effect after storage for one month was nil.

This shows that the use of a co-solvent does not necessarily give a product with improved stability.

Examples 1–3

Compositions were prepared as in Test B (the ingredients are given in Table 1) but with a different co-solvent. In these examples of the invention propylene glycol n-butyl ether was used as a co-solvent, but in differing amounts (2.5%, 5%, and 7.5%) in the three examples. Propylene glycol n-butyl ether is a solvent which is sparingly soluble in water and according to information from the supplier has a solubility in water at 20° C. of 6%. The documentation provided by the supplier does not explicitly state the basis on which solubility is calculated but it is believed to be weight/weight.

The compositions were evaluated as before. The composition containing 2.5% of co-solvent was hazy initially, and the initial hydrophobic effect was strong.

After storage for one month at ambient temperature the composition was hazy and the hydrophobic effect was fairly strong. On storage for one (1) month at 40° C. (a severe test of stability) a precipitate formed.

The composition containing 5% of co-solvent was slightly hazy initially and the initial hydrophobic effect was very strong.

After storage for one month at ambient temperature the composition was hazy and the hydrophobic effect was strong. On storage for 1 month at 40° C. (a severe test of stability) particles were observed dispersed in the aqueous medium.

It may be possible to accept some deficiencies in the physical stability of the composition, as indicated by its tendency to form hazy liquids or to produce particles on standing if its chemical stability, as indicated by the retention of hydrophobic properties on storage at ambient temperatures is improved by the presence of the co-solvent.

Comparative Test C

An experiment was carried out as in examples 1–3 except that the quantity of propylene glycol n-butyl ether used was 10%.

The initial stability was good and the initial hydrophobic effect was moderate.

On storage for one month at ambient temperature the composition separated into different liquid layers, and there was no hydrophobic effect.

On storage at 40° C. for one month the composition separated.

These results show the importance of avoiding excessive amounts of the co-solvent.

TABLE 1

| Ingredient | Test A % wt | Test B % wt | Ex. 1 % wt | Ex. 2 % wt | Ex. 3 % wt | Test C % wt |
|---|---|---|---|---|---|---|
| Deionized Water | 95.46 | 85.46 | 92.96 | 90.46 | 87.96 | 85.46 |
| Surfactant 1 | 2.00 | 2.00 | 2.00 | 2.00 | 2.00 | 2.00 |
| Surfactant 2 | 2.00 | 2.00 | 2.00 | 2.00 | 2.00 | 2.00 |
| Surfactant 3 | 0.36 | 0.36 | 0.36 | 0.36 | 0.36 | 0.36 |
| Lactic acid | to pH4 | to pH4 | to pH4 | to pH4 | to pH4 | to pH4 |
| Co-solvent 1 | 0.00 | 0.00 | 2.50 | 5.00 | 7.5 | 10.00 |
| Co-solvent 2 | 0.00 | 10.00 | 0.00 | 0.00 | 0.00 | 0.00 |
| Fluoro silane | 0.18 | 0.18 | 0.18 | 0.18 | 0.18 | 0.18 |

The quantities in each column add up to 100%. In some cases the ingredients used are supplied as concentrates containing less than 100% of active material. In such cases the amounts given are based on the weight of the concentrate as supplied and not on the proportion of active materials.

Surfactant 1 was benzalkonium chloride, supplied by Albright and Wilson under the trade name "Empigen BAC" as a concentrate containing 50% of active materials. The quantities quoted in the Table are based on the weight of material as supplied.

Surfactant 2 was an alcohol ethoxylate supplied by BASF under the trade name "Lutensol AO8".

Surfactant 3 is believed to be a cationic fluorosurfactant and was supplied by E I Du Pont de Nemours under the trade name "Zonyl FSD" as a concentrate containing 30% of active material.

The quantity of lactic acid was such as to adjust the pH to about 4.

Co-solvent 1 was a solvent which is sparingly soluble in water, namely propylene glycol n-butyl ether.

Co-solvent 2 was a solvent with a good solubility in water, namely propylene glycol methyl ether, supplied by Dow under the trade name "Dowanol PM".

The fluoro silane was a non-ionic solution of fluor aliphatic silyl ethers in ethanol containing 60% of fluoro compound, supplied by 3M under the designation FC-405-60. Details of this material are given above. It is stated by the supplier to undergo hydrolysis in the presence of water.

What I claim is:

1. A method of improving the physical and chemical stability of an aqueous solution containing a quantity of an organosilane of the formula $A_{3-x}B_xSiD$ provided that the organosilane fails to form a clear solution in water at 25° C. at the intended level of use of the organosilane, the method comprising:

including within the aqueous solution a surfactant selected from the group consisting of cationic surfactants, non-ionic surfactants, amphoteric surfactants and mixtures thereof, and at least 1% by weight based on the total weight of the aqueous solution of a glycol ether co-solvent to improve the physical and chemical stability of the aqueous solution, wherein the co-solvent has a solubility in water at 20° C. in the range of 1 to 25%, and A is —OH or a hydrolyzable group, B is a substituted or unsubstituted alkyl group of from 1 to 4 carbon atoms, x has a value of 0, 1 or 2, and D is a substituted or unsubstituted hydrocarbon group.

2. The method of claim 1 wherein:

A is an alkyl ether group.

3. The method of claim 2 wherein:

A is an alkyl ether group having a lower alkyl group having 1 to 4 carbon atoms.

4. The method of claim 1 wherein:

D is a hydrocarbon group including at least one fluorine substituent.

5. The method of claim 1 wherein:

D is a hydrocarbon group containing from 6 to 18 carbon atoms.

6. The method of claim 1 wherein:

the organosilane has the formula $Rf—X—Si(OR)_3$ wherein Rf is a perfluoroaliphatic group, X is a linking group containing an unsubstituted lower alkylene group, and R is methoxy or ethoxy.

7. The method of claim 1 wherein:

the quantity of the organosilane in the aqueous solution is 0.01% to 3% based on total weight of the aqueous solution.

8. The method of claim 1 wherein:

the surfactant is included in the aqueous solution in the range of 1% to 10% by weight based on the total weight of the aqueous solution.

9. The method of claim 1 wherein:

the amount of co-solvent included in the aqueous solution is in the range of 1% to 9% by weight based on the total weight of the aqueous solution.

10. The method of claim 9 wherein:

the amount of co-solvent included in the aqueous solution is in the range of 4% to 9% by weight based on the total weight of the aqueous solution.

11. The method of claim 9 wherein:

the co-solvent is selected from the group consisting of propylene glycol n-butyl ether, dipropylene glycol n-butyl ether, and dipropylene glycol n-propyl ether.

12. A method of improving the physical and chemical stability of an aqueous solution containing 0.01% to 3% by weight of an organosilane of the formula $A_{3-x}B_xSiD$ provided that the organosilane fails to form a clear solution in water at 25° C. at the intended level of use the organosilane, the method comprising:

including within the aqueous solution from 1% to 10% by weight based on the total weight of the aqueous solution of a surfactant selected from the group consisting of cationic surfactants, non-ionic surfactants, amphoteric surfactants and mixtures thereof, and from 1% to 9% by weight based on the total weight of the aqueous solution of a glycol ether co-solvent to improve the physical and chemical stability of the aqueous solution, wherein the co-solvent has a solubility in water at 20° C. in the range of 1 to 25%, and A is —OH or a hydrolyzable group, B is a substituted or unsubstituted alkyl group of from 1 to 4 carbon atoms, x has a value of 0, 1 or 2, and D is a substituted or unsubstituted hydrocarbon group.

13. The method of claim 12 wherein:

A is an alkyl ether group.

14. The method of claim 13 wherein:

A is an alkyl ether group having a lower alkyl group having 1 to 4 carbon atoms.

15. The method of claim 12 wherein:

D is a hydrocarbon group containing from 6 to 18 carbon atoms and including at least one fluorine substituent.

16. The method of claim 15 wherein:

the organosilane has the formula Rf—X—Si(OR)$_3$ wherein Rf is a perfluoroaliphatic group, X is a linking group containing an unsubstituted lower alkylene group, and R is methoxy or ethoxy.

17. An aqueous composition obtained by the method of claim 1.

18. An aqueous composition obtained by the method of claim 7.

19. An aqueous composition obtained by the method of claim 12.

20. An aqueous composition obtained by the method of claim 16.

* * * * *

UNITED STATES PATENT AND TRADEMARK OFFICE

CERTIFICATE OF CORRECTION

PATENT NO. : 6,300,379 B2
DATED : October 9, 2001
INVENTOR(S) : Richard W. Avery It is certified that error appears in the above-identified patent and that said Letters Patent is hereby corrected as shown below:

Column 1,
Line 44, replace "hydrolysable" with -- hydrolyzable --.

Column 6,
Line 40, after "level of use" insert -- of --.

Signed and Sealed this

Twenty-eighth Day of May, 2002

*Attest:*

*Attesting Officer*

JAMES E. ROGAN
*Director of the United States Patent and Trademark Office*